United States Patent [19]

Lang et al.

[11] 4,077,580

[45] Mar. 7, 1978

[54] METHOD FOR CONTROLLING THE ON-THE-FLY SPLICING OF A WEB FROM A SECOND ROLL TO A WEB RUNNING OFF A FIRST ROLL

[75] Inventors: Rainer Lang; Horst Matthiesen, both of Erlangen; Manfred Rubruck, Igelsdorf, all of Germany

[73] Assignee: Siemens Aktiengesellschaft, Munich, Germany

[21] Appl. No.: 759,245

[22] Filed: Jan. 13, 1977

[30] Foreign Application Priority Data

Apr. 30, 1976 Germany ..... 2619236

[51] Int. Cl.[2] ..... B65H 19/12

[52] U.S. Cl. ..... 242/58.2; 242/58.3

[58] Field of Search ..... 242/58.1, 58.2, 58.3, 242/58.4, 58.5; 156/504, 506

[56] References Cited

U.S. PATENT DOCUMENTS

| | | | |
|---|---|---|---|
| 3,351,297 | 11/1967 | Vits | 242/58.2 |
| 3,516,617 | 6/1970 | Haner | 242/58.2 |

FOREIGN PATENT DOCUMENTS

| | | | |
|---|---|---|---|
| 2,128,617 | 2/1973 | Germany | 242/58.3 |

*Primary Examiner*—Edward J. McCarthy
*Attorney, Agent, or Firm*—Kenyon & Kenyon, Reilly, Carr & Chapin

[57] ABSTRACT

A method for controlling the on-the-fly splicing of a web wound on a first roll to a web wound on a second roll, wherein the first roll is being unwound and the second roll is set in rotation. The method comprises the steps of: transferring a roll carrier supporting the first and second roll from the unwind position to the pasting position, when the first roll reaches one of a first diameter and first circumference value; accelerating the second roll until its peripheral velocity is equal to the velocity of the unwinding web on the first roll, when the first roll reaches one of a second diameter and second circumference value; and operating a pasting and cutting means for pasting the web of the second roll beginning at the pasting tip of the web of the second roll, to the web running off the first roll and for cutting the web running off the first roll at the end of the pasting tab formed by the pasted section of the first and second rolls when the first roll reaches one of a third diameter and third circumference value. In accordance with the invention, the method further comprises the step of continuously calculating the aforesaid diameter or circumference values from a predetermined value for the end diameter of the first roll, a predetermined value for the length of the pasting tab, from one of predetermined and measured time constants of the mechanical members carrying out the method, and from the actual values for the velocity of the web of the first roll and for the rotation of the first roll.

3 Claims, 1 Drawing Figure

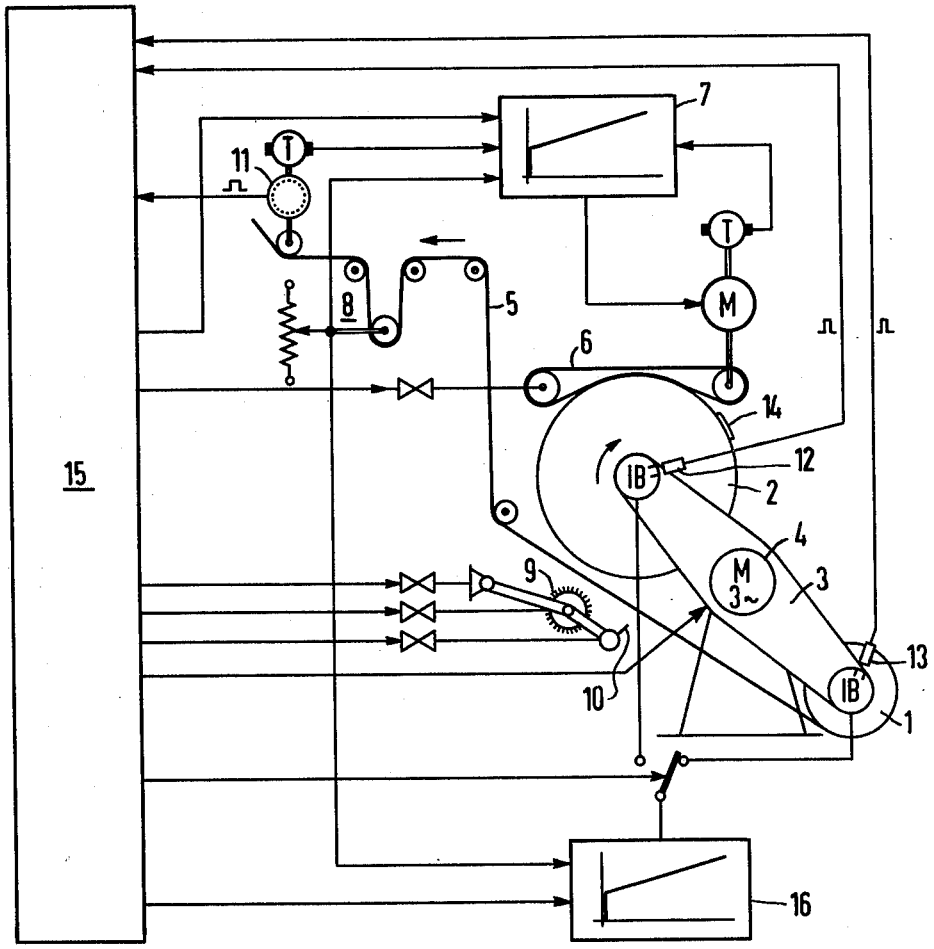
7
11
T
T
M
8
5
6
14
12
IB
2
4
M
3~
3
9
13
IB
1
10
15
16

METHOD FOR CONTROLLING THE ON-THE-FLY SPLICING OF A WEB FROM A SECOND ROLL TO A WEB RUNNING OFF A FIRST ROLL

BACKGROUND OF THE INVENTION

1. Field of the Invention

The invention relates to a method for controlling the on-the-fly splicing of a web wound on a second or new roll, set in rotation, to a web wound on a first or old roll and, more particularly, to a method for controlling such splicing when changing the web wound rolls in a rotary printing press.

2. Description of the Prior Art

A typical prior art method for controlling the on-the-fly splicing of a web wound on a second roll to a web wound on a first roll is carried out in the following manner: the roll carrier containing both rolls is swung from the roll-off (unwind) position into the pasting position, when the first roll reaches a first diameter or circumference value; the second roll is accelerated and its peripheral velocity is made equal to the velocity of the web of the first roll when the first roll reaches a second diameter or circumference value; and a pasting and cutting device is operated for pasting the pasting tip at the start of the web of the second roll to the web running off the first roll and for cutting off the aforesaid web behind the pasted point, when the first roll reaches a third diameter or circumference value.

The aforesaid prior art method is disclosed in German Auslegeschrift DT-AS 1,147,599, DT-AS 1,082,901 and the German Petty Patent DT-GM 1,867,437. As disclosed therein, the individual phases of the roll splicing are initiated as a function of the decrease of the diameter or the circumference of the first roll. In practice, fixed settings of several diameter or circumference values are used for instituting the individual phases and the corresponding control elements are addressed when the first roll reaches the respective set diameter or circumference values. The fixed settings are determined on the basis of empirical values and for safety reasons, the respective fixed settings or starting points are chosen relatively early.

The thickness of the web of the first roll is determined from the area weight given by the manufacturer by means of tables and is also set to a fixed value. Thus, unavoidable thickness changes of the web are not taken into consideration during the splicing procedure. Moreover, the changing of rolls is time consuming and the time of cutting off of the web of the first roll is of insufficient accuracy to avoid having the end diameter of such roll vary over a wide range.

It is, therefore, an object of the present invention to provide a method of the above-described type which permits faster operation and improved accuracy in the end diameter of the first or old roll.

SUMMARY OF THE INVENTION

In accordance with the principles of the present invention, the above and other objectives are realized in a method of the above-described type wherein the diameter of circumference values of the first roll used as starting points to institute the different operating phases of the method via corresponding control elements are continuously determined from a predetermined value for the diameter of the first roll, a predetermined value for the length of the pasting tab, from predetermined or measured time constants of the mechanical members and from actual values for the web velocity and for the rotation of the first roll.

If a web pulse generator, driven by the web of the first roll, for generating web pulses and further pulse generators coupled with the first and second rolls for generating pasting marks are used, one embodiment of the method according to the invention provides that the velocity of the web of the first roll is determined from the number of web pulses per unit time; that the circumference of the first roll is calculated from the number of web pulses between successive pasting mark pulses of such roll; and that the thickness of the web of the first roll is calculated from the decrease of the circumference between successive pasting mark pulses.

As can be appreciated from the above method of the present invention, preset, constant diameter or circumference values of the first and second rolls are not used as starting points for the respective control elements. Rather, the desired end diameter of the first roll is predetermined as a fixed value and the diameter or circumference values are computed continuously. As a result, the starting points for the control elements corresponding to such values are continuously optimized. In particular, the changing from the first roll to the second roll can now begin at a later time and be completed in a shorter time than in prior art methods of this type. Since the starting points for the control elements depend upon the continuously calculated diameter or circumference values, the execution time for a roll change becomes independent of the web velocity. The belt drive can be lifted from the first roll at a later time and thus can keep the web on the first roll as long as possible. The stress on the second roll is thereby reduced. Moreover, the second roll is not accelerated longer than is necessary and does not rotate more often than is necessary. This reduces the danger that the pasting tip might come loose because of air getting under the beginning of the web of the second roll. As the desired length of the pasting tab is held more accurately and likewise, the end diameter of the first roll is held more accurately, the length of the web remaining on the first roll is shortened. Additionally, due to continuously determining the web thickness, unavoidable thickness deviations are taken into consideration immediately. Thus, the method of the present invention allows maintaining a desired end diameter of the second roll with a tolerance which is in the order of 1 mm.

BRIEF DESCRIPTION OF THE DRAWING

The above and other features and aspects of the present invention will become apparent upon reading the following detailed description in conjunction with the accompanying drawing, in which:

FIG. 1 shows apparatus for carrying out the method of the present invention.

DETAILED DESCRIPTION

FIG. 1 shows apparatus for carrying out the method of the present invention. As shown a drive motor 4 provides drive power to a double-arm-roll carrier 3 upon whose one arm is supported a first or old roll 1 from which a paper web 5 unwinds, and upon whose other arm is supported new or second roll 2.

In the normal unwind position of the roll carrier 3, the old roll 1 runs in the upper position of its supporting arm under a belt drive 6. The belt drive 6 is controlled by a control device 7 as a function of the position of the oscillating roll 8 and in such a manner that a predetermined constant tension is realized, at which there is no danger of the web tearing. In preparation for the changing of rolls, the belt drive 6 is lifted off the roll 1 and the arms of the roll carrier are rotated into the pasting position shown in the figure. In such position, the old roll 1 is in the lower position, in which it is driven by the pulling force of the unwinding web 5, but not by the belt drive 6. In order to avoid strong fluctuations of the tension and hunting of the roll 1 in this position, a brake for the roll, designed as an induction brake, assumes control over the tension of the web roll via a further control device 16.

After the roll carrier 3 has been rotated into the pasting position shown the belt drive 6 is lowered and accelerates the roll 2. The control device 7 of the belt drive 6 is controlled at this time so as to bring the roll 2 up to a speed at which its circumferential velocity corresponds to the web velocity of the running-off web 5. Under this condition, no or only very small tension forces occur at the pasting point during the pasting operation.

In particular, the beginning of the web of the roll 2 is provided with a pasting tip 14. When the pasting tip 14 is in a suitable position as, for example, when it is positioned as shown in the figure, the unwinding web is pushed against the new roll 2 by the operation of a brush roller 9. The pasting occurs when the pasting tip 14 of the new roll passes under the brush roller 9. Soon thereafter, the web unwinding from the old roll 1 is cut off by the operation of a cutting device 10. As will be described, hereinafter, the aforesaid cutting of the web 1 is controlled so that the section of the web from the end of the pasting tip up to the severed web end called the pasting tab has a predetermined accurately controlled length. This avoids problems when the spliced roll is later run through a printing press.

After the pasting operation, the roll 1 is subsequently braked by the residual-roll brake. When it stops rotating it is removed from the roll carrier and another roll is inserted on the roll carrier arm. Since the roll carrier 3 is already in the unwind position for the roll 2, the belt drive is then switched to tension control for ensuring a predetermined constant tension of the roll 2 during the unwinding of the web thereon.

During the aforesaid operation of the roll-carrier 3, measuring pickups are provided for monitoring certain conditions of the rolls 1 and 2. In particular, a web pulse generator 11 driven by the unwinding web 5 is provided, which generates a predetermined number of web pulses per unit of length. The number of web pulses referred to a time base is a measure of the web velocity. Additionally, measuring pickups 12 and 13 are also provided. These pickups are associated with the respective rolls 1 and 2. Each generates so called pasting mark pulses when a marking, the so-called pasting mark, provided on the shaft of its respective roll radially below the pasting tip of the roll, runs past a sensor. A pasting mark pulse is thus generated by each of the pickups 12 and 13 for each revolution of its respective roll.

As can be appreciated, the pasting mark pulse of the unwinding roll 1 is a circumference pulse. Thus, the number of web pulses from the web pulse generator 11 between two successive pasting mark pulses is a measure of the circumference of the unwinding roll 1. The thickness of the roll, in turn, is obtained from the decrease of the circumference of the roll during two or more revolutions.

To control the operating cycle of the roll carrier 3 for the changing of the rolls 1 and 2, a computing means 15 is provided, to which is fed the web pulses from the web pulse pickup 11 and the pasting mark pulses from the measuring pickups 12 and 13. During the changing operation, only the pasting mark pulses of the unwinding roll 1 are released. The computing device 15 controls the corresponding control elements for the motion cycle of the roll changing as a function of the decrease of the diameter of the roll 1. In particular, in accordance with the invention, the respective starting points for the various phases of the cycle are determined as a function of a predetermined end diameter for the roll 1, a predetermined length of the pasting tab, a predetermined or measured value for the time span encompassing the time in which the carrier arm is rotated from the unwind position into the pasting position and the dead times of the brush roller 9 and the cutting device 10, and from the actual values of the circumference of the roll 1.

The aforesaid determination of the respective starting points is based on the following differential equation defining the behavior of the unwinding roll:

$$D(t) = D_{anf} - v \cdot \delta \cdot (2/\pi) \cdot \int (1/D)\, dT, \qquad (1)$$

where $D$ = the diameter of the unwinding roll 1,
$D_{anf}$ = the initial diameter of the roll 1,
$v$ = the web velocity and
$\delta$ = the thickness of the web.

From Equation 1, one obtains for the diameter $D_i$, which is the diameter from which a residual time $T_i$ passes until a predetermined end diameter $D_R$ of the roll 1 is reached, the following:

$$D_i = \sqrt{\frac{4 \cdot T_i \cdot \delta \cdot v + D_R^2}{\pi}} \qquad (2)$$

To solve Equation (2), the actual values for the thickness $\delta$ of the web and the web velocity $v$, which are obtained in the manner already described from the web pulses and the pasting mark pulses, as well as residual time setting $T_i$ are required.

In carrying the above-described roll changing operation of the apparatus of FIG. 1, a first diameter value is determined using Equation (2) for the start of the rotating motion of the arm of the roll-carrier 3. The residual time $T_i$ employed in this determination is the sum of the time required by the carrier arm to move from the unwind position into the pasting position, the time for accelerating the new roll and the time for settling the new roll after the acceleration process. The time required by the carrier arm to move from the unwind position into the pasting position can be increased by a margin of safety. The acceleration time for the new roll is predetermined as a fixed value, and the settling time is likewise given as a fixed value and may correspond, for example, to the time for five revolutions of the new roll.

A second diameter value is then determined for the start of the acceleration of the new roll. For this determination, the residual time is pre-set as the sum of the predetermined acceleration time and the settling time of the new roll. A third diameter value is thereafter calculated for the starting of the brush roller. At this time, the residual time used is the sum of the dead time of the brush roller and the dead time of the cutting device, as well as of the running through of the pasting tab.

Finally, a fourth diameter value is determined for the starting of the cutting device. The residual time in this case is the sum of the dead time of the cutting device and the particular time which is required, at the respective web velocity, to obtain a pasting tab of predetermined length.

It may also be advantageous to determine an additional diameter or circumference value, at which diameter value the acceleration transmitter in the drive control of the roll 1 is cut off. The acceleration transmitter is cut off at that pasting mark at which there is no longer any assurance that the instant for the rotating movement of the carrier arm has not yet passed and if the web velocity is increasing up to the next pasting mark. By cutting off the acceleration transmitter, the unwinding roll can no longer be accelerated.

What is claimed is:

1. In a method for controlling the on-the-fly splicing of a web wound on a first roll to a web wound on a second roll, wherein the first roll is being unwound and the second roll is set in rotation and wherein mechanical members are associated with the carrying out of the method and the method includes:

transferring a roll carrier supporting the first and second rolls from the unwind position to the pasting position, when the first roll reaches one of a first diameter and first circumference value;

accelerating the second roll until its peripheral velocity is equal to the velocity of the unwinding web on the first roll, when the first roll reaches one of a first diameter and first circumference value;

accelerating the second roll until its peripheral velocity is equal to the velocity of the unwinding web on the first roll, when the first roll reaches one of a second diameter and second circumference value; and operating a pasting and cutting means for pasting the web of the second roll beginning at the pasting tip of the web of the second roll, to the web running off the first roll and for cutting the web running off the first roll at the end of the pasting tab formed by the pasted section of the first and second rolls when the first roll reaches one of a third diameter and third circumference value; and wherein the improvement comprises:

continuously calculating said values from a predetermined value for the end diameter of said first roll, a predetermined value for the length of the pasting tab, from one of predetermined and measured time constants of the mechanical members carrying out said method, and from the actual values for the velocity of the web of said first roll and for the rotation of said first roll.

2. In a method in accordance with claim 1 wherein a web pulse transmitter is provided for generating web pulses associated with the web of said first roll and wherein further pulse transmitters are provided for generating pasting mark pulses for the web of said first and second rolls; and wherein the improvement further comprises:

determining the web velocity of the web of said first roll from the number of web pulses per unit time;

determining the circumference of the first roll from the number of web pulses between successive pasting mark pulses of the first roll; and determining the thickness of the web of said first roll from the decrease of the circumference between successive pasting mark pulses of said web of said first roll.

3. In a method in accordance with claim 1, wherein an acceleration transmitter is provided in the drive control controlling the driving of the first roll for controlling the acceleration of the first roll, and wherein the improvement further comprises:

controlling of the acceleration transmitter so as to prevent further acceleration of the first roll, when the first roll reaches one of a fourth diameter and circumference value; and determining said one of a fourth diameter and circumference value.

* * * * *